US008991419B2

(12) United States Patent
Brice

(10) Patent No.: US 8,991,419 B2
(45) Date of Patent: Mar. 31, 2015

(54) VENTURI VALVE PRESSURE COMPENSATOR APPARATUS AND METHOD

(76) Inventor: John L. Brice, Colorado Springs, CO (US)

( * ) Notice: Subject to any disclaimer, the term of this patent is extended or adjusted under 35 U.S.C. 154(b) by 341 days.

(21) Appl. No.: 12/925,814

(22) Filed: Oct. 29, 2010

(65) Prior Publication Data

US 2012/0104299 A1 May 3, 2012

(51) Int. Cl.
*F16K 21/04* (2006.01)
*E03C 1/084* (2006.01)

(52) U.S. Cl.
CPC ..... *E03C 1/084* (2013.01)
USPC ..... 137/513.3; 137/3; 137/888

(58) Field of Classification Search
CPC ..... E03C 1/084
USPC ..... 137/895, 888, 896, 3, 114, 603; 4/541.5, 541.6, 596
See application file for complete search history.

(56) References Cited

U.S. PATENT DOCUMENTS 2,741,467 A * 4/1956 Lee et al. ..... 239/428.5
2,761,662 A * 9/1956 Goodrie ..... 239/428.5
2,837,323 A * 6/1958 Goodrie ..... 239/579
2,888,209 A * 5/1959 Hjulian ..... 239/428.5
2,889,999 A * 6/1959 Tomlinson ..... 239/428.5
2,971,701 A * 2/1961 Shames et al. ..... 239/587.4
3,138,332 A * 6/1964 Hinderer ..... 239/427
3,216,451 A * 11/1965 Smallpeice ..... 137/861
3,847,178 A * 11/1974 Keppel ..... 137/515.7
4,000,857 A * 1/1977 Moen ..... 239/428.5
4,082,225 A * 4/1978 Haynes ..... 239/428.5
4,426,040 A * 1/1984 Smith ..... 239/428.5
4,568,027 A * 2/1986 Lazarus ..... 239/590.3
4,573,639 A * 3/1986 Logue ..... 239/428.5
5,381,957 A * 1/1995 Bianco ..... 239/99
5,514,267 A * 5/1996 Machiya et al. ..... 210/170.06
5,794,643 A 8/1998 Brice
5,934,328 A * 8/1999 Conrad et al. ..... 137/896
6,182,703 B1 2/2001 Brice
6,260,273 B1 7/2001 Brice
7,201,331 B2 * 4/2007 Bertrand ..... 239/318
7,416,171 B2 8/2008 Brice

* cited by examiner

*Primary Examiner* — John K Fristoe, Jr.
*Assistant Examiner* — Umashankar Venkatesan
(74) *Attorney, Agent, or Firm* — J. Nevin Shaffer, Jr.

(57) ABSTRACT

A venturi valve pressure compensator apparatus and method include a venturi valve with an inlet and an outlet and with a small diameter opening at the inlet and a large diameter opening at the outlet and with an air intake opening. An insert, with a front and a back, is provided such that the front of the insert faces the small diameter opening of the venturi valve. At least one hole is provided in the insert that extends through the insert from front to back. A pressure seal is located at the back of the insert, the pressure seal conformed to seal leaks around the insert and force fluid to flow through the at least one hole.

15 Claims, 5 Drawing Sheets

VENTURI VALVE PRESSURE COMPENSATOR APPARATUS AND METHOD

FIELD OF THE INVENTION

This invention relates to a venturi valve pressure apparatus and method. In particular, in accordance with one embodiment, the invention relates to a venturi valve pressure compensator apparatus consisting of a venturi valve with an inlet and an outlet and with a small diameter opening at the inlet and a large diameter opening at the outlet and with an air intake opening. An insert, with a front and a back, is provided such that the front of the insert faces the small diameter opening of the venturi valve. At least one hole is provided in the insert that extends through the insert from front to back. A pressure seal is located at the back of the insert, the pressure seal conformed to seal leaks around the insert and force fluid to flow through the hole(s) in the insert.

BACKGROUND OF THE INVENTION

Fluctuating fluid pressure presents many problems to fluid flow systems. By way of example only and not limitation, shower systems are adversely affected, sometimes dangerously so, when water pressure fluctuates. Everyone has experienced the pain of suddenly fluctuating hot/cold water pressure while taking a shower. As a result, commercially available pressure compensating devices have been developed. These prior art pressure compensators work with great precision to control water volume throughput when hooked up to a conventional showerhead.

There is a problem, however, when it comes to attempting to regulate showerheads that are non-conventional. Again by way of example only and not by limitation, "venturi valves" introduce air into the water flow so as to reduce water consumption. Applicant has developed an entire series of systems that conserve water while maintaining the "feel" of a "normal" conventional water flow in a shower or water faucet.

Applicant's "venturi valves" include, among other things, an inlet and an outlet. A small diameter opening is located at the inlet and a large diameter opening is located at the outlet. An air intake opening is provided that connects with either the large diameter or small diameter opening. This combination of elements provides the user with the benefits of water conservation with no loss of comfort and results in showers and faucets that are, therefore, superior to conventional systems.

There is a problem, however, with regard to these venturi valve systems when fluid pressure fluctuates. Applicant has found that venturi valve systems simply respond to the pressure delivered in an expected manner. The systems produce a flow rate delivery that is associated with the water pressure existing in the static line at the time of delivery. That is, if water pressure increases, then the flow rate in gallons per minute (gpm) also increases. If the water pressure falls, then the flow rate in gpm correspondingly falls off as well.

Applicant has determined by testing that conventional pressure compensators, however, simply do not work with venturi valve systems. In order for venturi valves to function properly, they must prime themselves and any disruption at the beginning of the process results in failure. All that is required to create disruption is for water to eddy at the beginning of use. Again, conventional pressure compensators are incapable of preventing disruption and fail in providing pressure compensation for venturi type valves.

Thus, there is a need in the art for a pressure compensation device that works with venturi type valves, that is simple to install and that does not interfere with the water conservation features of these venturi valves.

It, therefore, is an object of the invention to provide a pressure compensation apparatus and method that guarantees pressure compensation for venturi valves, that is simple to install and that does not denigrate the desired water conservation features of such valves.

SUMMARY OF THE INVENTION

Accordingly, the venturi valve pressure compensator apparatus of the present invention, according to one embodiment includes a venturi valve with an inlet and an outlet and with a small diameter opening at the inlet and a large diameter opening at the outlet and with an air intake opening. An insert with a front and a back is provided and positioned such that the front faces the small diameter opening. At least one hole is created in the insert from front to back and a pressure seal is provided and located at the back of the insert. The pressure seal is conformed to seal leaks around the insert and force flow through the at least one hole.

As used herein, terms are given their ordinary and common meaning as known by those of ordinary skill in the art. Thus, the term "venturi valve" describes a valve that at a minimum includes an inlet and an outlet. A small diameter opening is located at the inlet and a large diameter opening is located at the outlet. An air intake opening is provided that connects with either the large diameter or small diameter opening. Applicant's U.S. Pat. Nos. 5,794,643; 6,182,703; 6,260,273; and 7,416,171 are exemplary.

It should be noted that typically there is a larger opening upstream of the small diameter opening in the form of a female connector, for example only. It should be made clear that this large diameter opening in no way is to be construed as a vital and necessary part of the functional vacuum venturi of the past and present invention. It is merely bringing water supply to the small diameter opening of the venturi valve. The vacuum venturi begins at the entry way of the small diameter opening, leading to a large diameter opening, intersected along the way by an air inlet. This constitutes the functional aspects of the prior patented valves and of the present invention. In no way should it be construed as necessary to recognize the larger diameter connection to an incoming water supply as playing a vital part in the premise of the vacuum venturi valve being comprised of a small diameter opening leading to a larger diameter opening intersected by a perpendicular air inlet. The connection to a large diameter inlet source cannot be considered as necessary. This fact holds true for devices attached to the entry side of the patented venturi apparatus, but does not hold true for the leaving side.

Because of the variety of different types of devices that can be attached to the leaving side of the venturi apparatus, the smaller inlet diameter can be attached to a larger outlet diameter that is provided by the attached device itself.

Further, the length of the smaller throughput diameter will vary in accordance with the required "ballast" effect that is generated by the attached, larger outlet diameter device, and the amount of vector force it generates (due to its internal volume capacity) when pushing back against the incoming, smaller diameter's water stream as its flow of water makes its way through the venturi apparatus toward the larger outlet diameter device attached. This "ballast" effect (and the balancing of the inward and outward vector forces that are being produced by the movement of water from the small diameter opening to the larger diameter opening, as well as the resistance of the opposing vector of the attached device), all play a role in the eventual production of a functional vacuum venturi apparatus. Therefore, the larger diameter outlet can be a functional part of the vacuum venturi device, and/or be provided in an ancillary, attached device which is added to and/or connected to the small diameter opening of the venturi apparatus, by male thread attachments as illustrated.

In another aspect, the insert is conformed to fit into the venturi valve itself and the back faces the direction of flow into the venturi valve. "Flow" is used to describe the motion and direction of fluid through the invention. The fluid could be any fluid, of course, such as water, obviously, but may be other types of fluid now known or hereafter developed. Thus, for example only, water flows into a house in a pipe and brings the flow of water to faucets and shower nozzles which "face" the "flow" and require that the flow pass through them prior to delivery to the user, as is known in the art.

In one aspect, the insert is cylindrically shaped. In another aspect, the insert includes more than one hole and in a further aspect, there are approximately twelve holes in the insert.

In another aspect, the pressure seal is a flexible rubber washer. In one aspect, the pressure seal includes a center hole and the center hole aligns with the at least one hole in the insert and in another aspect, the center hole is smaller than the back of the insert such that the pressure seal covers at least a portion of the back of the insert.

In a further aspect, the venturi valve is selected from a group of venturi valves consisting of venturi valves in which: the air intake opening intersects the small diameter opening; the air intake opening intersects the large diameter opening; the air intake opening penetrates all the way through either the small diameter opening or the large diameter opening so as to create dual air intake openings; and the air intake opening and the small diameter opening are a single unit conformed to connect with a separate large diameter opening.

In one aspect, the insert further includes an O-ring adjacent the at least one hole. As used herein, the term "O-ring" describes a common device in the shape of a donut. It has a circular shape with a hole in the center of the shape. Certainly, it may be of any other shape as well. Preferably, the O-ring is "compressible". As that term is used herein, it describes a material that is resilient such that it is flexible enough to deform and expand under pressure but retract to its original shape when pressure is reduced. That is, the O-ring of the present invention flattens out and expands as a result of water pressure created by the flow of water in the system as the pressure increases. As pressure declines, the O-ring retracts and begins to return to its original form and dimension.

According to another embodiment of the invention, a venturi valve pressure compensator apparatus includes a venturi valve with an inlet and an outlet and with a small diameter opening at the inlet and a large diameter opening at the outlet and with an air intake opening. An insert with a front and a back is provided such that the front faces the small diameter opening, where the back includes an opening with an O-ring retainer in the opening and where the insert is conformed to fit into the venturi valve and the back faces the direction of flow into the venturi valve. More than one hole is provided in the insert from front to back and an O-ring is connected with the O-ring retainer.

In another aspect of this invention, a pressure seal is located at the back of the insert where the pressure seal is conformed to seal leaks around the insert and force flow through the at least one hole, where the pressure seal includes a center hole and where the center hole aligns with the holes in the insert.

In other aspects of this invention, there are approximately twelve holes in the insert, the pressure seal is a flexible rubber washer and the O-ring is a compressible rubber, and the center hole of the rubber washer is smaller than the back of the insert such that the pressure seal covers at least a portion of the back of the insert.

In one aspect, the venturi valve is selected from a group of venturi valves consisting of venturi valves in which: the air intake opening intersects the small diameter opening; the air intake opening intersects the large diameter opening; the air intake opening penetrates all the way through either the small diameter opening or the large diameter opening so as to create dual air intake openings; and the air intake opening and the small diameter opening are a single unit conformed to connect with a separate large diameter opening.

According to another embodiment, a venturi valve pressure compensator method consists of the steps of:

a. providing a venturi valve with an inlet and an outlet and with a small diameter opening at the inlet and a large diameter opening at the outlet and with an air intake opening; an insert with a front and a back where the front faces the small diameter opening; at least one hole in the insert from front to back; and a pressure seal where the pressure seal is conformed to seal leaks around the insert and force flow through the at least one hole; and b. placing the insert and the pressure seal in position with the venturi valve such that the front of the insert faces the small diameter opening with the pressure seal is at the back of the insert.

In one aspect, the insert is conformed to fit into the venturi valve and the back faces the direction of flow into the venturi valve. In another aspect, the insert includes an opening with an O-ring retainer in the opening and the further step of connecting an O-ring with said O-ring retainer.

In a further aspect, the pressure seal includes a center hole and the center hole aligns with the at least one hole in the insert. In another aspect, the center hole is smaller than the back of the insert such that the pressure seal covers at least a portion of the back of the insert.

In a further aspect, the venturi valve is selected from a group of venturi valves consisting of venturi valves in which: the air intake opening intersects the small diameter opening; the air intake opening intersects the large diameter opening; the air intake opening penetrates all the way through either the small diameter opening or the large diameter opening so as to create dual air intake openings; and the air intake opening and the small diameter opening are a single unit conformed to connect with a separate large diameter opening.

DESCRIPTION OF THE DRAWINGS

Other objects, features and advantages of the present invention will become more fully apparent from the following detailed description of the preferred embodiment, the appended claims and the accompanying drawings in which:

FIG. 1 B a side view of the air intake opening intersecting the large diameter opening; FIG. 1 C a side view of the air intake opening penetrating all the way through the small diameter opening and producing dual air intake openings; FIG. 1 D a side view of the air intake opening penetrating all the way through the large diameter opening and producing dual air intake openings; and FIG. 1 E a side view of the air intake opening and the small diameter opening in a single unit conformed to connect with a separate large diameter opening;

DETAILED DESCRIPTION OF THE INVENTION

Figure 1A:
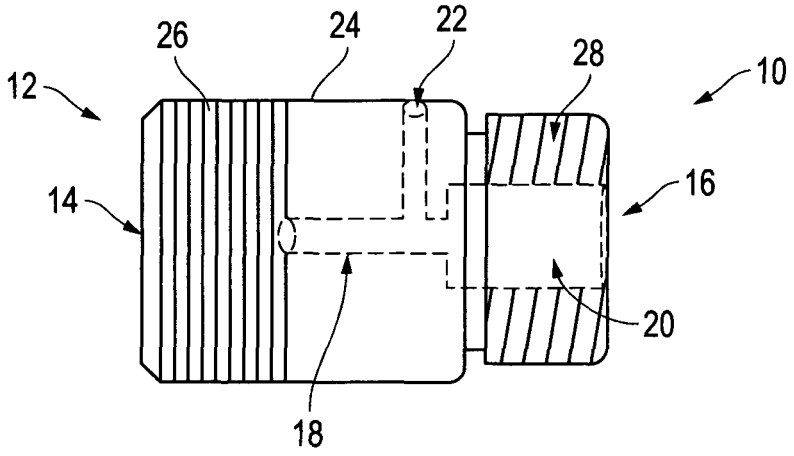
FIGS. 1 A-E are side partial section views of the venturi valves of the venturi valve pressure compensator of the present invention with FIG. 1A a side view of the air intake opening intersecting the small diameter opening.
Figure 1B:
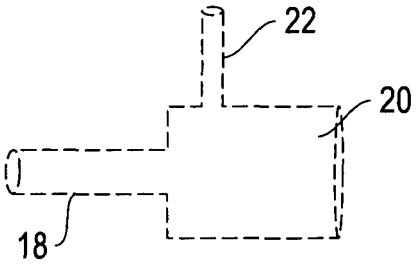
Figure 1C:
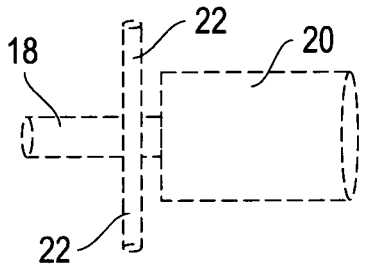
Figure 1D:
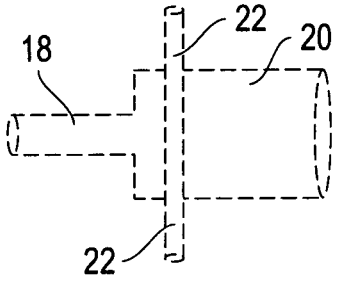
Figure 1E:
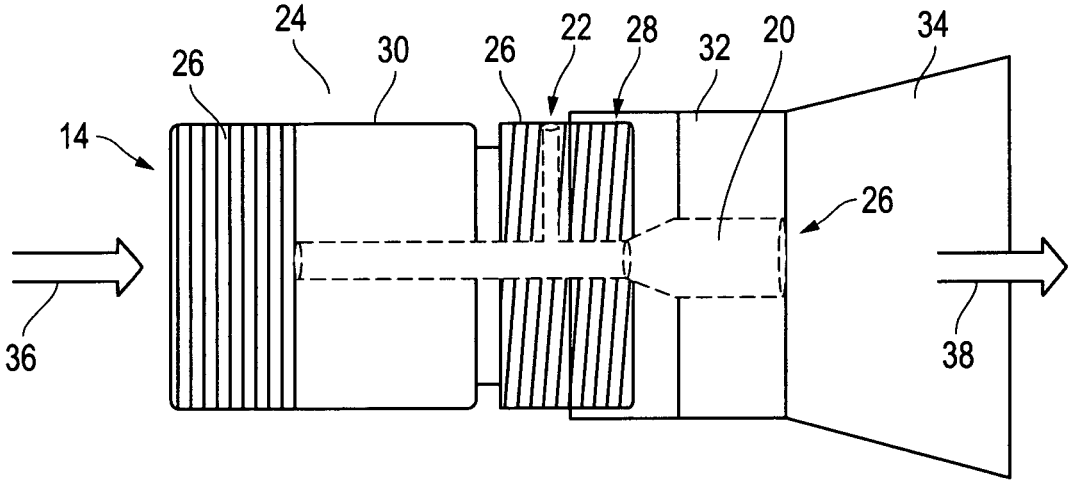

The preferred embodiment of the present invention is illustrated by way of example in FIGS. 1-7. With specific reference to FIGS. 1 A-E, the venturi valve pressure compensator 10 includes a venturi valve 12 with an inlet 14 and an outlet 16 and with a small diameter opening 18 at the inlet 14 and a large diameter opening 20 at the outlet 16 and with an air intake opening 22. These elements are contained within a valve body 24 which may have male threads 26 on the outside of valve body 24 or female threads 28 on the inside of valve body 24 as is known in the art, all as illustrated in FIG. 1 A.

FIG. 1 A illustrates a venturi valve 12 in which the air intake opening 22 intersects the small diameter opening 18.

FIG. 1 B does not include valve body 24 for clarity in order to illustrate the important feature of this embodiment of the venturi valve 12. In this embodiment, air intake opening 22 intersects the large diameter opening 20.

FIG. 1 C does not include valve body 24, for clarity, and illustrates a venturi valve 12 in which the air intake opening 22 intersects the small diameter opening 18 and passes all the way through valve body 24 (not shown) so as to create two air intake openings 22 as shown.

FIG. 1 D also does not include valve body 24, for clarity, and illustrates a venturi valve 12 in which the air intake opening 22 intersects the large diameter opening 20 and passes all the way through valve body 24 (not shown) so as to create two air intake openings 22 as shown.

FIG. 1 E illustrates the embodiment of the invention in which the valve body 24 is created from two separate elements, element 30 and element 32. In this embodiment, element 30 includes air intake opening 22 and small diameter opening 18 in a single unit separate and apart from element 32.

Element 32 includes large diameter opening 20. Element 32 includes female threads 28, for example only and not by way of limitation, that co-operate with male threads 26 on element 30 so that element 30 when joined with element 32 creates the required small diameter opening 18 connection with the large diameter opening 20 of the venturi valve 12 of the present invention.

FIG. 1 E also illustrates shower nozzle 34. In operation, water flows in the direction of direction arrow 36 into the inlet 14, through the venturi valve 12 and out of the outlet 16 in the direction of direction arrow 38.

Figure 2:
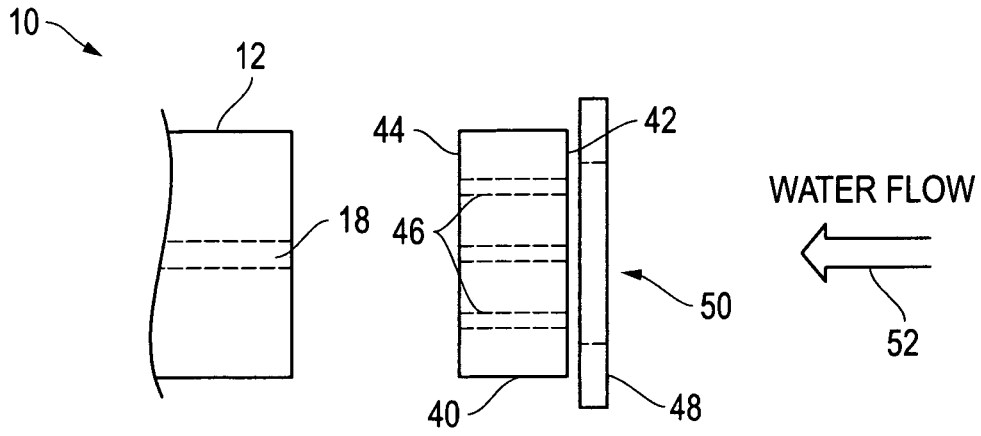
FIG. 2 is a side partial section view of the insert and pressure seal according to one embodiment of the invention.

Referring now to FIG. 2, other elements of the venturi valve pressure compensator 10 according to one embodiment are illustrated. Insert 40 includes a front 42 and a back 44. A hole 46 passes through insert 40. At least one hole 46 is provided as indicated by dashed lines. Applicant has determined by testing and experimentation that approximately twelve holes 46 provide the most desirable effect.

FIG. 2 also illustrates a pressure seal 48. As is shown and as will be described more fully hereafter with regard to FIG. 4, pressure seal 48 is designed to be located at the back 44 of insert 40 such that the pressure seal 48 seals fluid leaks around the insert 40 and forces fluid to flow through the hole(s) 46.

Importantly, pressure seal 48 includes a center hole 50, as indicated by dashed lines. As more clearly shown in FIG. 5, in a preferred embodiment, center hole 50 aligns with the hole (s) 46 in the insert 40, and, preferably, center hole 50 is smaller than the back 44 of insert 40 such that the pressure seal 48 covers at least a portion of the back 44 of insert 40. Here again, Applicant has determined by testing that this is a preferred arrangement having discovered that this combination keeps insert 40 in place and prevents insert 40 form moving around as water flows past it. In fact, pressure seal 48 keeps insert 40 from bobbing or spinning without causing any perturbation to the water flow that would disturb the flow and prevent the creation of the venturi.

FIG. 2 shows the direction of water flow through the invention by way of direction arrow 52 toward the small diameter opening 18 in venturi valve 12 as illustrated.

Figure 3:
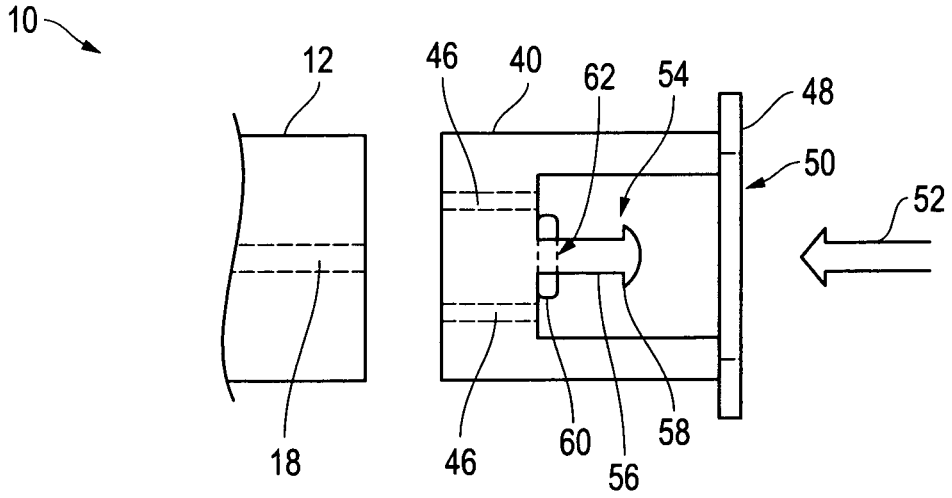
FIG. 3 is a side partial section view of the insert and pressure seal according to another embodiment of the invention.

Referring now to FIG. 3, according to another preferred embodiment, insert 40 consists includes an opening 54. Opening 54 is a recess in the back 44 of insert 40. Within opening 54 is O-ring retainer 56. In this aspect, O-ring retainer is a post in the center of insert 40 as shown. O-ring retainer includes a lip 58. O-ring 60 fits over O-ring retainer 56 and is held in place by lip 58. Obviously O-ring 60 includes a hole 62 (not shown but indicated by dotted lines).

By testing, Applicant has determined that the insert 40 according to this embodiment is dramatically stable in a wide range of pressure fluctuations. The direction arrow 52 shows the direction of flow first past pressure seal 48 then into the back 44 of insert 40, then past O-ring 60, through holes 46 and into small diameter opening 18 in venturi valve 12 as before. The function of O-ring 60 is more fully described with reference to FIGS. 6 and 7 hereafter.

Referring now to FIG. 4, direction arrow 52 again shows the direction of the flow into venturi valve 12. The flow first contacts the pressure seal 48 at the back 44 of insert 40. Again, pressure seal 48 prevents water from flowing around pressure seal 48 and forces water to flow through the center hole 50 and into the back 44 of insert 40. Insert 40 in this embodiment is located within a well 13 of venturi valve 12 but it could be outside of it in the same location as well 13. Well 13 is a machined opening in venturi valve 12 conformed to just receive insert 40 as shown. In any event, the flow passes through insert 40 hole(s) 46 (not shown in this figure) and into small diameter opening 18, then large diameter opening 20 to outlet 16 as described.

Figure 4:
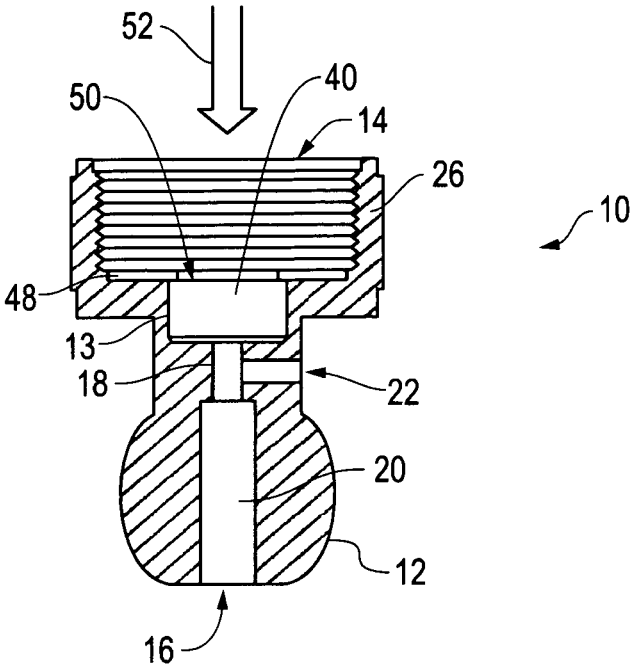
FIG. 4 is a side partial section view of the venturi valve pressure compensator of the present invention according to one embodiment.

The venturi valve 12 shown in FIG. 4 is as described in FIG. 1 A but, of course, could be any type of venturi valve now known or hereafter developed.

Figure 5:
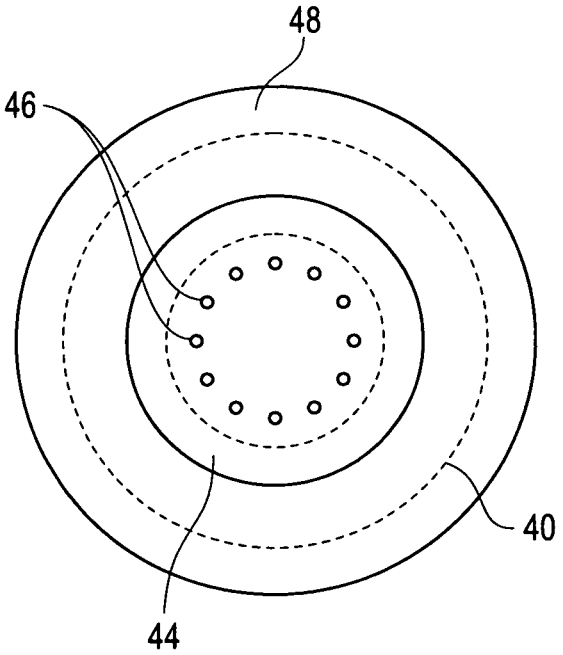
FIG. 5 is a back view of the pressure seal in place at the back of the insert, the insert including an O-ring retainer and an O-ring.

FIG. 5 shows a preferred embodiment in which pressure seal 48 includes a center hole 50 that aligns with hole(s) 46 in insert 40 but which is smaller than the dimension of insert 40 (shown in dotted lines). Thus pressure seal 48 will cover a portion of the back 44 of insert 40. Applicant has determined that this greatly assists in the sealing effect and, as described above, effectively prevents any movement of insert 40 within well 13.

Figure 6:
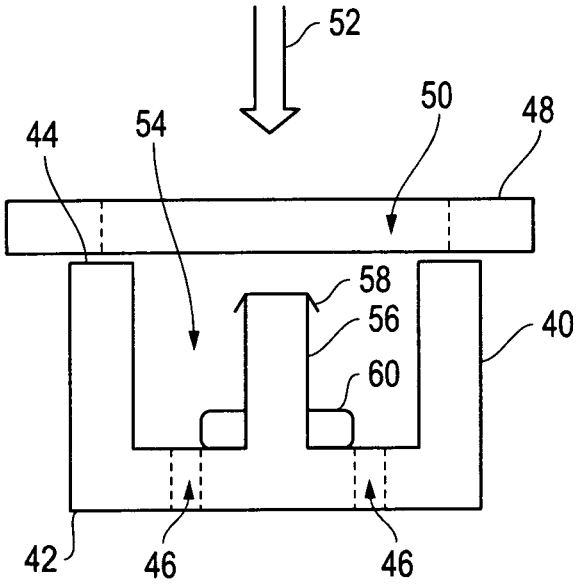
FIG. 6 is a side section view of the insert with and O-ring retainer and O-ring showing the O-ring in an uncompressed condition and not covering holes in the insert.
Figure 7:
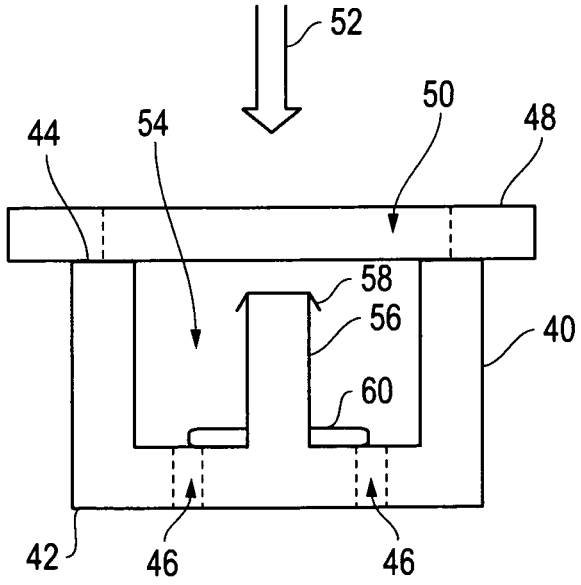
FIG. 7 is a side section view of the invention of FIG. 6 showing the O-ring compressed and expanded under pressure to partially cover holes in the insert.

Referring now to FIGS. 6 and 7, the operation of the venturi valve pressure compensator 10 according to a preferred embodiment is described. FIG. 6 shows insert 40 with an opening 54 in the back 44. In the center of the opening 54 is an O-ring retainer 56. O-ring 60 is held in place within opening 54 by connection with O-ring retainer 56. FIG. 6 shows water flowing in the direction of direction arrow 52 past pressure seal 48 into center hole 50 and then into the opening 54. At the pressure suggested in FIG. 6, O-ring 60 does not cover holes 46 in insert 40 and water flows from holes 46 into the small diameter opening 18 as described.

FIG. 7 shows the function of O-ring 60 under increased water pressure conditions. As water pressure increases, compressible O-ring 60 flattens out and expands. As it expands it partially obstructs holes 46 thus decreasing the flow of water through the venturi valve 12. That is, as the pressure increases, O-ring 60 flattens out across the holes 46 and lets less water through. Likewise, as the pressure lessens, the O-ring 60 retracts and lets more water through. Applicant has determined that venturi valve pressure compensator 10 works across a psi range of about 20 psi to 80 psi and keeps the flow rate consistent at or about one to one point two gallons per minute across that entire range. This provides a pressure compensated vacuum venturi system that runs the same gallons per minute at twenty psi as at eighty psi, a truly unexpected, but much desired, result.

By way of further description, Applicant has through extensive testing determined that successfully compensating a vacuum venturi apparatus as discussed herein depends heavily upon making fine adjustments in the relationship of the air intake opening 18 to the small diameter opening 18 and the large diameter opening 20 as well as manipulating the length of the small diameter opening 18 relative to where it finally intercepts the large diameter opening 20. Taken in combination with the issue of pressure compensation, an extraordinarily complex matter of physics is involved. Applicant believes that the difficulty of pressure compensating a venturi based vacuum valve apparatus lies in the introduction of the incoming inlet stream of water into the inlet 14 of venturi valve 12. The precise manner in which any pressure compensating device controls this interface is critical for its successful operation.

In the final analysis, Applicant has found that the combination of the insert 40 in combination with the pressure seal 48 provides the required pressure compensation result for a venturi valve system. Again, tests show that the venturi valve pressure compensator 10 according to the present invention functions successfully across a psi water pressure range of 20 psi to 80 psi while operating in a pressure compensating mode and while still maintaining the integrity of its vacuum flow venturi capability. The 20 psi to 80 psi range is important as an effective operational range of the present invention because that is the prevailing industry standard. Nonetheless, the present invention is certainly not limited to this range and is effective above and below this range as well.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A venturi valve pressure compensator apparatus comprising:

a. a venturi valve with an inlet and an outlet and with a small diameter opening at said inlet and a large diameter opening at said outlet and with an air intake opening;

b. an insert with a front and a back wherein said front faces said small diameter opening and is connected with said inlet, wherein said back includes a recess with an O-ring retainer connected to said back in said recess wherein said O-ring retainer is a cylindrical post of one constant diameter such that said O-ring retainer does not stretch an O-ring along said O-ring retainer when said O-ring is in position around said O-ring retainer and wherein said insert is connected with said venturi valve at said inlet;

c. at least one hole in said insert from front to back; and d. wherein said O-ring is compressible and does not cover said at least one hole when not compressed and wherein said O-ring at least partially covers said at least one hole when compressed and wherein said O-ring surrounds said cylindrical post and contacts the back of said insert at said cylindrical post such that said O-ring seals itself around said cylindrical post and no openings exist between said O-ring and said cylindrical post.

2. The apparatus of claim 1 wherein said insert is inside said venturi valve and said back faces the direction of flow into said venturi valve.

3. The apparatus of claim 1 wherein said insert includes more than one hole.

4. The apparatus of claim 1 further including a pressure seal at said back of said insert wherein said pressure seal is conformed to seal leaks around said insert and force flow through said at least one hole, wherein said pressure seal includes a center hole and wherein said center hole aligns with the more than one hole in said insert.

5. The apparatus of claim 4 wherein said pressure seal is a flexible rubber washer and said O-ring is a compressible rubber O-ring.

6. The apparatus of claim 4 wherein said center hole is smaller than the back of said insert such that said pressure seal covers at least a portion of said back of said insert.

7. The apparatus of claim 1 wherein said venturi valve is selected from a group of venturi valves consisting of venturi valves in which: the air intake opening intersects the small diameter opening; the air intake opening intersects the large diameter opening; the air intake opening penetrates all the way through either the small diameter opening or the large diameter opening so as to create dual air intake openings; and the air intake opening and the small diameter opening are a single unit conformed to connect with a separate large diameter opening.

8. The apparatus of claim 1 wherein said cylindrical post is connected in a space at the back of said insert wherein said space extends from said cylindrical post outward to said at least one hole and wherein said O-ring at least partially covers said space but not said at least one hole when not compressed.

9. A venturi valve pressure compensator method comprising:

a. providing a venturi valve with an inlet and an outlet and with a small diameter opening at said inlet and a large diameter opening at said outlet and with an air intake opening; an insert with a front and a back wherein said front faces said small diameter opening; wherein said back includes a recess with an O-ring retainer connected to said back in said recess wherein said O-ring retainer is a cylindrical post of one constant diameter such that said O-ring retainer does not stretch an O-ring when said O-ring is in position around said O-ring retainer; at least one hole in said insert from front to back; and a pressure seal conformed to seal leaks around said insert and force flow through said at least one hole;

b. placing said insert and said pressure seal in position with said venturi valve such that the front of the insert faces the small diameter opening and is connected with said inlet and wherein the pressure seal is located at said back of said insert and is connected with said back of said insert; and c. connecting an O-ring with said O-ring retainer adjacent said at least one hole at said back of said insert in between said pressure seal and said back of said insert and wherein said O-ring surrounds said cylindrical post and contacts the back of said insert at said cylindrical post such that said O-ring seals itself around said cylindrical post and no openings exist between said O-ring and said cylindrical post.

10. The method of claim 9 wherein said insert is located inside said venturi valve and said back faces the direction of flow into said venturi valve.

11. The method of claim 9 wherein said pressure seal includes a center hole and wherein said center hole aligns with the at least one hole in said insert.

12. The method of claim 11 wherein said center hole is smaller than the back of said insert such that said pressure seal covers at least a portion of said back of said insert.

13. The method of claim 9 wherein said venturi valve is selected from a group of venturi valves consisting of venturi valves in which: the air intake opening intersects the small diameter opening; the air intake opening intersects the large diameter opening; the air intake opening penetrates all the way through either the small diameter opening or the large diameter opening so as to create dual air intake openings; and the air intake opening and the small diameter opening are a single unit conformed to connect with a separate large diameter opening.

14. The method of claim 9 wherein said O-ring is compressible and does not cover said at least one hole when not compressed and wherein said O-ring at least partially covers said at least one hole when compressed.

15. The method of claim 9 wherein said cylindrical post is connected in a space at the back of said insert wherein said space extends from said cylindrical post outward to said at least one hole and wherein said O-ring at least partially covers said space but not said at least one hole.

* * * * *